US009192809B1

(12) United States Patent
Miller et al.

(10) Patent No.: US 9,192,809 B1
(45) Date of Patent: Nov. 24, 2015

(54) EXERCISE DEVICE

(71) Applicants: Larry D. Miller, Rochester, MI (US); Bradley Jordan Miller, Royal Oak, MI (US)

(72) Inventors: Larry D. Miller, Rochester, MI (US); Bradley Jordan Miller, Royal Oak, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 14/659,682

(22) Filed: Mar. 17, 2015

Related U.S. Application Data

(60) Provisional application No. 62/055,806, filed on Sep. 26, 2014.

(51) Int. Cl.

| | |
|---|---|
| ***A63B 22/00*** | (2006.01) |
| ***A63B 21/00*** | (2006.01) |
| ***A63B 22/06*** | (2006.01) |

(52) U.S. Cl.
CPC ..... *A63B 22/0015* (2013.01); *A63B 21/1465* (2013.01); *A63B 21/155* (2013.01); *A63B 22/001* (2013.01); *A63B 22/0664* (2013.01); *A63B 2022/0676* (2013.01)

(58) Field of Classification Search
None
See application file for complete search history.

(56) References Cited

U.S. PATENT DOCUMENTS

| | | | | |
|---|---|---|---|---|
| 5,795,268 | A | 8/1998 | Husted | |
| 6,113,518 | A | 9/2000 | Maresh et al. | |
| 7,507,184 | B2 | 3/2009 | Rodgers, Jr. | |
| 7,678,025 | B2 | 3/2010 | Rodgers, Jr. | |
| 7,708,668 | B2 | 5/2010 | Rodgers, Jr. | |
| 7,811,208 | B2 | 10/2010 | Rodgers, Jr. | |
| 7,878,947 | B1 | 2/2011 | Rodgers, Jr. | |
| 7,946,281 | B2 | 5/2011 | Miller | |
| 8,021,275 | B2 | 9/2011 | Rodgers, Jr. | |
| 8,092,351 | B1 | 1/2012 | Rodgers, Jr. | |
| 8,944,966 | B2 * | 2/2015 | Miller | 482/52 |
| 8,979,714 | B2 * | 3/2015 | Miller | 482/52 |
| 9,017,223 | B2 * | 4/2015 | Eschenbach | 482/52 |
| 2005/0124466 | A1 * | 6/2005 | Rodgers, Jr. | 482/52 |
| 2005/0124467 | A1 * | 6/2005 | Rodgers, Jr. | 482/52 |
| 2007/0219061 | A1 | 9/2007 | Rodgers, Jr. | |
| 2010/0137110 | A1 * | 6/2010 | Rodgers, Jr. | 482/52 |

* cited by examiner

*Primary Examiner* — Stephen Crow
(74) *Attorney, Agent, or Firm* — Dinsmore & Shohl LLP

(57) ABSTRACT

An exercise device has a frame supporting guide links and foot support links. Upper pulleys are pivotally connected to the frame or guide links, front lower pulleys are connected to the guide links or foot support links and rear lower pulleys are connected to the foot support links. A flexible element extends from a vertical drive assembly to the upper pulley, front lower pulley, rear lower pulley and then to the frame rearward of the guide link pivot.

27 Claims, 13 Drawing Sheets

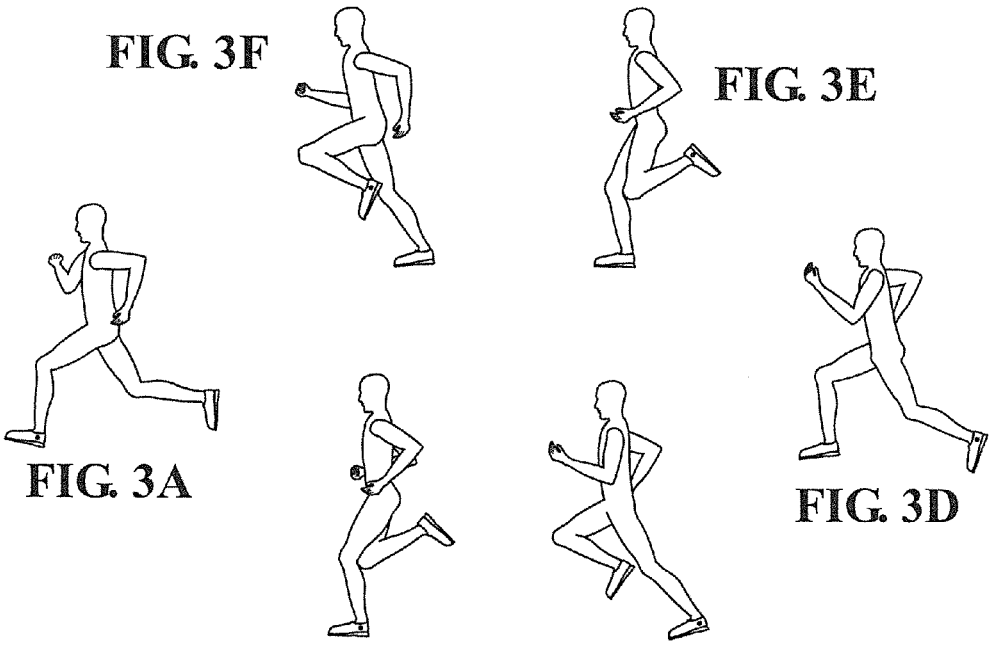
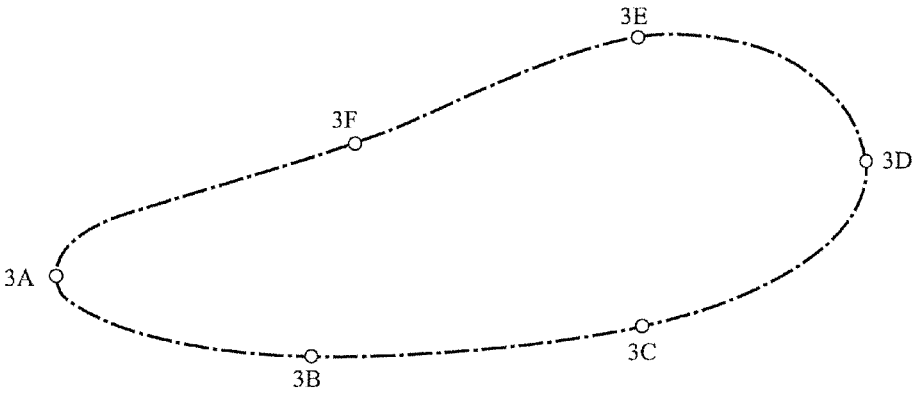
FIG. 4

EXERCISE DEVICE

CROSS-REFERENCE TO RELATED APPLICATIONS

This application claims priority of U.S. provisional application Ser. No. 62/055,806, filed Sep. 26, 2014, the contents of which are incorporated herein by reference.

FIELD OF THE INVENTION

This invention relates to exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links are pivotally supported on a frame and a foot engaging link is supported at the lower end of each guide link. An intermediate link connects each guide link to crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control element engages each foot link and extends up and over a pulley located at the guide link pivot axis. The control elements connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

U.S. patent application Ser. Nos. 14/643,587 and 14/643,522, filed Mar. 10, 2015, both to the present inventors, disclose various embodiments of exercise machines making use of a cam system and control followers driven by the cam system, with the followers driving vertical and/or horizontal motion of foot receiving areas of foot support links. Each of these applications is incorporated herein, in their entirety, by reference. The embodiments disclosed therein may be modified to utilized embodiments of the present invention.

SUMMARY OF THE INVENTION

The present invention provides multiple embodiments of exercise devices. According to one embodiment, an exercise device has a frame configured to be supported on a horizontal surface, the frame having a first pivot axis defined thereon. A first and a second guide link each has a first and a second attachment point defined thereon. Each guide link is pivotally attached, through its first attachment point, to the frame at the first pivot axis thereof. A first and a second foot support link each has a foot receiving area configured to support a user's foot thereupon. Each foot support link is pivotally connected to the second attachment point of a respective one of the guide links so that when the guide links pivot relative to the frame, they each cause the respective foot receiving area to move in a path of travel having a horizontal component of motion. A first and a second upper pulley are each pivotally connected to the frame or a respective one of the guide links, with each upper pulley rotating about an upper axis. A first and a second front lower pulley are each pivotally connected to a respective one of the guide links or foot support links below the upper pulleys, with each front lower pulley rotating about a front lower axis. A first and a second rear lower pulley are each pivotally connected to a respective one of the foot support links rearward of the respective front lower pulley, with each rear lower pulley rotating about a rear lower axis. A vertical drive assembly is supported on the frame. A first and a second flexible element each has a first end in communication with the vertical drive assembly, a second end connected to the frame rearward of the first pivot axis and a midportion extending between the first and second ends. The midportion of each flexible extends about a respective upper pulley, front lower pulley and rear lower pulley. The vertical drive assembly is operable via the flexible elements to move the foot receiving areas of the foot support links in a path of travel having a vertical component of motion.

In some versions, the upper pulleys are pivotally connected to the respective guide link and the upper axis of the upper pulleys are each offset downwardly from the first attachment point. As such, when each foot receiving area is at its rearmost extent of the path of travel having a horizontal component of motion, the foot receiving area is lifted upwardly by the respective flexible element as compared to if the upper axis was aligned with the first attachment point. In certain alternatives, the upper axis of each upper pulley is are offset downwardly from the first attachment point by a distance of at least 2 inches, and, in further alternatives, at least 3 inches.

In certain alternatives, each of the guide links has a guide length defined between the first and second attachment point and each of the flexible couplings has a foot support portion extending between a respective rear lower pulley and an attachment point on the frame. The foot support portion is generally parallel to the respective guide link throughout the motion of the device. In some versions, the foot support portion has a length that is similar to the guide length when the respective foot support link is at a midpoint of vertical travel. The respective first attachment point, second attachment point, guide on the frame and coupling point on the foot support portion may generally define a parallelogram when the respective foot support link is at the midpoint of vertical travel.

In some versions, the pivotal motion of the guide links about the first attachment points is decoupled from the motion of the foot receiving areas along the path of travel having a vertical component of motion so that the user can achieve a foot path that is generally vertical or a blend of vertical and horizontal motion.

In other versions, the device has a horizontal drive assembly supported on the frame and a first and a second mechanical horizontal control coupling each coupling a respective one of the guide links to the horizontal drive assembly such that the horizontal drive assembly is operable to pivot the guide links about the first pivot axis, thereby causing the foot receiving areas to move in the path of travel having a horizontal component of motion. Therefore, movement of each foot receiving area in the path of travel having a vertical component of motion is generally out of phase with the movement in the path of travel having a horizontal component of motion such that when the horizontal component of motion of each foot receiving area is at its forwardmost or rearwardmost limit, the vertical component of motion of the same foot receiving area is approximately midway between its uppermost and lowermost limit, whereby the foot receiving area of each foot support link moves in a generally elliptical path.

The device may also include a crank system supported on the frame for rotation about a crank axis, with the crank system defining the vertical drive assembly and the horizontal drive assembly. The mechanical horizontal control couplings may each comprise a horizontal control link having one end connected to the crank system and an opposite end connected to a respective one of the guide links. The horizontal control link may be connected to an attachment portion of the respective guide link, the connection to the attachment portion being adjustable such that a range of the path of travel having a horizontal component of motion is adjustable.

In some versions, the vertical drive assembly is a crank supported on the frame for rotation about a crank axis, the crank having a first and a second crank arm each coupled to a respective one of the flexible elements.

In certain versions, the device has a cam system with a vertical control cam portion and a horizontal control cam portion, the cam portions supported for rotation about cam axes. The vertical control cam portion has a first and a second offset vertical drive portion and the horizontal control cam portion has a first and second offset horizontal drive portion. A vertical follower support is disposed on the frame, the vertical follower support having a vertical follower pivot axis defined thereon. A first and a second vertical control follower are each pivotally connected to the vertical follower support at the vertical follower pivot axis, each vertical control follower further having a control portion and a cam engagement portion, the cam engagement portion having a cam engagement surface engaging a respective one of the offset vertical drive portions of the vertical cam portion such that as the vertical cam portion rotates about the respective cam axis, the offset vertical drive portions cause the vertical control followers to pivot back and forth about the vertical follower pivot axis thereby causing the control portions to oscillate back and forth. The control cam portion, vertical follower support, and vertical control followers define the vertical drive assembly and the first end of each flexible element is connected to the control portion of the respective one of the vertical control followers. A horizontal follower support is disposed on the frame, the horizontal follower support having a horizontal follower pivot axis defined thereon. A first and a second horizontal control follower are each pivotally connected to the horizontal follower support at the horizontal follower pivot axis, each horizontal control follower further having a control portion and a cam engagement portion, the cam engagement portion having a cam engagement surface engaging a respective one of the offset horizontal drive portions of the horizontal cam portion such that as the horizontal cam portion rotates about the respective cam axis, the offset horizontal drive portions cause the horizontal control followers to pivot back and forth about the horizontal follower pivot axis thereby causing the control portions to oscillate back and forth. A first and a second mechanical horizontal control coupling each couple a respective one of the guide links to the control portion of a respective one of the horizontal control followers such that as the horizontal cam portion rotates about the respective cam axis, the mechanical horizontal control couplings pivot the guide links about the first pivot axis, thereby moving the foot support areas of the foot support links in a path of travel having a horizontal component of motion. Movement of each foot receiving area in the path of travel having a vertical component of motion is generally out of phase with the movement in the path of travel having a horizontal component of motion such that when the horizontal component of motion of each foot receiving area is at its forwardmost or rearwardmost limit, the vertical component of motion of the same foot receiving area is approximately midway between its uppermost and lowermost limit. Therefore, the foot receiving area of each foot support link moves in a generally elliptical path when the cam portions rotate about the cam axes.

In some alternatives, the first offset vertical drive portion and the first offset horizontal drive portion are generally coaxial and the second offset vertical drive portion and the second offset horizontal drive portion are generally coaxial.

In some versions, the vertical control followers are disposed generally perpendicular to the horizontal control followers.

In some versions, the at least one of the follower supports is a movable support operable to move the respective follower pivot axis relative to the respective cam axis so as to alter a range of travel of the control portion of the respective control followers, thereby altering a range of the path of travel. A control actuator may move the movable control follower support.

The control followers may be elongated elements. In one version, each has one end pivotally connected to the follower support, an opposite end defining the control portion, and a midportion defining the cam engagement portion. In a second version, each has one end pivotally connected to the follower support, an opposite end defining the cam engagement portion, and a midportion defining the control portion. In a third version, each has one end defining the cam engagement portion, an opposite end defining the control portion, and a midportion pivotally connected to the follower support.

In some versions, the cam engagement portion of the control follower is a slot.

Some versions of the exercise device include a cam system having a vertical control cam portion and a horizontal control cam portion, the cam portions supported for rotation about cam axes, the vertical control cam portion having a first and a second offset vertical drive portion, the horizontal control cam portion having a first and second offset horizontal drive portion. A vertical follower support is disposed on the frame, the vertical follower support having a vertical follower pivot axis defined thereon. A first and a second vertical control follower each has a lower end pivotally connected to the vertical follower support at the vertical follower pivot axis. Each vertical control follower also has an upper control portion and a cam engagement portion, the cam engagement portion having a cam engagement surface engaging a respective one of the offset vertical drive portions of the vertical cam portion such that as the vertical cam portion rotates about the respective cam axis, the offset vertical drive portions cause the vertical control followers to pivot back and forth about the vertical follower pivot axis thereby causing the control portions to oscillate back and forth. The control cam portion, vertical follower support, and vertical control followers define the vertical drive assembly and the first end of each flexible element is connected to the control portion of the respective one of the vertical control followers. In some alternatives, each flexible element extends generally rearwardly from the respective control portion to the respective upper pulley.

In some versions, each front lower pulley is connected to the respective guide link and the front lower axis of each front lower pulley is spaced above the respective second attachment point of the respective guide link.

In other versions, each front lower pulley is connected to the respective foot support link and the front lower axis of each front lower pulley is spaced behind the respective second attachment point of the respective guide link.

In yet other versions, each foot support link has a forward end that is pivotally connected to the second attachment point of the respective guide link and a rearward end defining the foot receiving area, each rear lower pulley being connected to the respective foot support link between the forward and rearward ends of the foot support link.

In some versions, each of the guide links further includes a hand portion extending upwardly from the first attachment point.

In certain versions, the device has an adjustable resistance element coupled to the cam system.

In some versions, the device has a horizontal coordination linkage linking the first guide link to the second guide link such that pivotal movement of one of the guide links in a first direction causes pivotal movement of the other of the guide links in an opposite direction. An adjustable horizontal resistance element may be coupled to the guide links for providing resistance to the path of travel having a horizontal component of motion.

In another embodiment of the present invention, an exercise device has a frame configured to be supported on a horizontal surface, the frame having a first pivot axis defined thereon. A first and a second guide link each has a first and a second attachment point defined thereon, each guide link being pivotally attached, through its first attachment point, to the frame at the first pivot axis thereof, each of the guide links having a guide length defined between the first and second attachment point. A first and a second foot support link each has a foot receiving area to support a user's foot thereupon, each foot support link having a forward end pivotally connected to the second attachment point of a respective one of the guide links so that when the guide links pivot relative to the frame, the guide links each cause the foot receiving area of the respective foot support link to move in a path of travel having a horizontal component of motion. A first and a second upper pulley are each pivotally connected to the frame or a respective one of the guide links, each upper pulley rotating about an upper axis. A first and a second lower pulley are each pivotally connected to a respective one of the foot support links rearward of the forward end, each lower pulley rotating about a lower axis. A vertical drive assembly is supported on the frame. A first and a second flexible element each has a first end in communication with the vertical drive assembly, a second end connected to the frame rearward of the first pivot axis and a midportion extending between the first and second ends. The midportion of each flexible element extends about a respective upper pulley and rear lower pulley. Each of the flexible elements has a foot support portion extending between the respective lower pulley and the frame, the foot support portion being generally parallel to the respective guide link throughout the elliptical motion of the device. The foot support portion further has a length when the respective foot support link is at a midpoint of vertical travel that is similar to the guide length. The vertical drive assembly is operable via the flexible elements to move the foot receiving areas of the foot support links in a path of travel having a vertical component of motion.

BRIEF DESCRIPTION OF THE DRAWINGS

FIGS. 3A-3F show a runner at various stages in a stride;

FIG. 4 shows the path of foot travel achieved by the runner in FIGS. 3A-3F

DETAILED DESCRIPTION OF THE PREFERRED EMBODIMENTS

Figure 1:
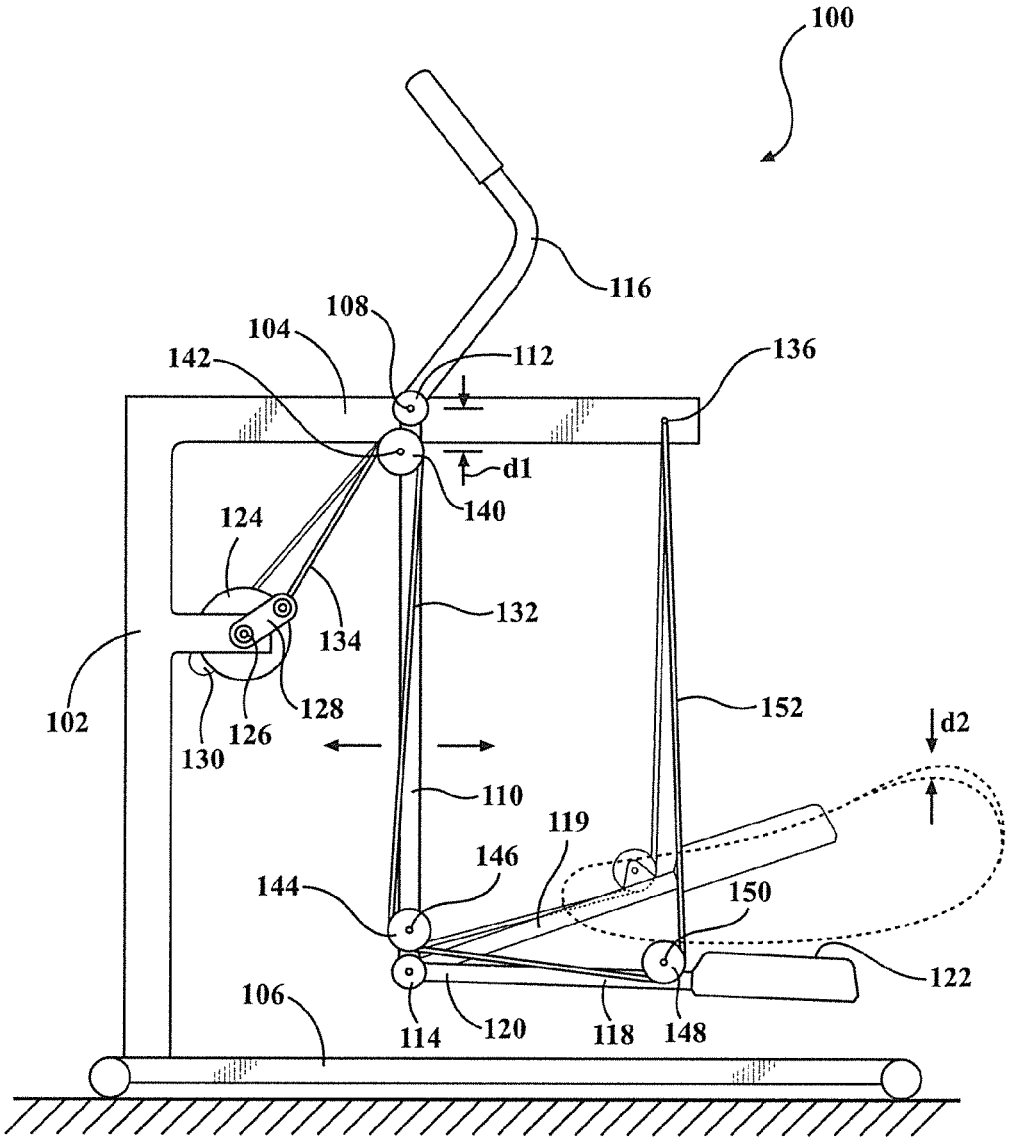
FIG. 1 is a side view of a first embodiment of an exercise device in accordance with the present invention.
Figure 2:
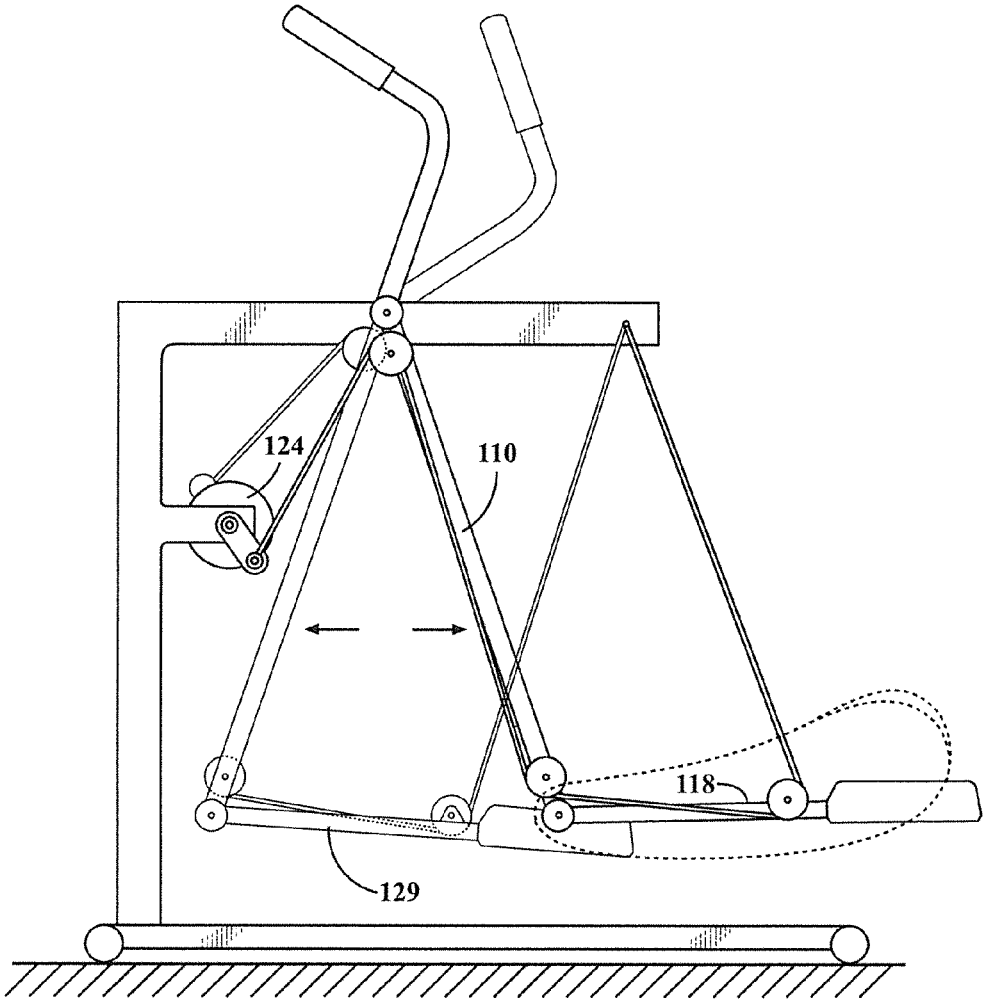
FIG. 2 is another side view of the first embodiment with the guide links pivoted to a fore-aft position.

The present invention will be explained with reference to several particular embodiments, including variations and optional features of these embodiments. It is to be understood that yet other embodiments, modifications, and variations thereof will be apparent to those of skill in the art in view of the teaching presented herein. Further, features and elements of certain embodiments may be combined with each other in combinations other than those illustrated and variations and optional features may be used with any of the embodiments.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Referring now to FIG. 1, a first embodiment of an exercise device in accordance with the present invention is shown generally at 100. The illustrated device is a free stride type device in which the extent of horizontal motion is controlled by the user. However, the device 100 may be modified to include a horizontal control system, such as from one of the other embodiments, in order to convert the device into a fixed path device. The illustrated device 100 includes a frame 102 which is configured and operative to retain and support the various other components of the device on a horizontal surface such as a floor. The frame 102 is typically fabricated from metal and/or composite materials, but any material may be used. The frame 102 has an upper portion 104 and a lower portion 106. The lower portion 106 is configured to contact the horizontal surface while the upper portion 104 supports several components of the device. A first pivot axis 108 is defined in a middle area of the upper portion 104 of the frame 102. The frame 102 may be said to have a forward portion forward of the first pivot axis 108, which is to the left in the view of FIG. 1, and a rearward portion rearward of the first pivot axis 108, which is to the right in the view of FIG. 1. As will be clear to those of skill in the art, exercise devices such as those described herein include left and right elements for supporting the respective left and right feet of the user. The right and left components of the device are typically substantially the same, though the machine may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIG. 1 shows a side view of the device 100 with the left elements most visible.

A pair of guide links are pivotally interconnected with the frame so as to be pivotal about the first pivot axis 108. The left guide link 110 is shown at the midpoint of its travel with the right guide link hidden behind it. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from a first attachment point 112. Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end. A crank system 124 is pivotally interconnected with the frame 102 such that a crank system 124 rotates about a second pivot axis 126 defined on the frame 102. The second pivot axis 126 also serves as the crank axis. In this embodiment, the crank system 124 is forward of the first pivot axis 108 and the second pivot axis 126 is below the first pivot axis 108. The crank system 124 has a pair of crank arms 128 and 130 that are 180 degrees apart. The crank system 124 represents one type of drive assembly, which in this case is a vertical drive assembly.

A flexible element 132 couples the crank arm 128 to the respective foot support link 118 such that rotation of the crank system 124 causes the foot receiving area 122 of the foot support link 118 to move upwardly and downwardly, which is a path of travel having a vertical component of motion. The flexible element 132 may be a cable or strap, or another type of flexible element. One end 134 of the element 132 is connected to crank arm 128 and an opposite end 136 is connected to the upper part 104 of the frame 102 rearward of the first pivot axis 108. The end 136 also defines a frame attachment point 136. A midportion of the flexible element 132 passes over various pulleys such that as the crank system 124 rotates, the foot receiving areas are moved upwardly and downwardly.

An upper pulley 140 is pivotally mounted to the guide link 110 at an upper axis 142 a short distance d1 below the first pivot axis 108. A front lower pulley 144 is pivotally mounted to the guide link 110 at a front lower axis 146 just above the second attachment point 114. The front lower pulley is generally directly below the upper pulley 140 when the guide link 110 is at the illustrated midpoint of travel. A rear lower pulley 148 is pivotally mounted to the foot support link 118 rearward of the front lower pulley 144 and rotates about a rear lower axis 150.

As shown, the flexible element 132 extends from the end 134 over the upper pulley 140, down to and under the front lower pulley 144, rearward and under the rear lower pulley 148 and back up to the end and frame attachment point 136.

The illustrated configuration provides a parallelogram-type configuration. The flexible element 132 may be said to have a foot support portion 152 extending between the rear lower pulley 148 and the frame coupling point 136. This foot support portion 152 is generally parallel to the respective guide link 110 at all times. Further, the guide link 110 may be said to have a guide length defined between the first attachment point 112 and second attachment point 114. The length of the foot support portion 152 of the flexible element 132 varies with the position of the foot support link 118. In FIG. 1, the foot support link 118 is shown in a lower position. The right foot support link 119 is shown in the upward position. As will be clear from the figure, the length of the foot support portion 152 of the flexible element 132 when the foot support link is at a midpoint of its vertical travel is similar to or generally the same as the guide length of the guide link 110. As such, the first attachment point 112, second attachment point 114, rear lower pulley 148, and attachment point 136 generally define a parallelogram when the foot support link 118 is at a midpoint of its vertical travel. This parallelogram-type configuration provides a desirable motion profile. Alternatively, the foot support portion 152 may be parallel to the guide link 110 without the lengths matching.

As mentioned previously, the illustrated embodiment of the exercise device 100 is a free stride type device. This means that horizontal travel of the foot support portions depends on how much fore-aft force is applied to the foot receiving areas or hand portions by the user. Horizontal travel occurs as the guide links 110 pivot about the first pivot axis 108. Alternatively, the exercise device 100 may be a fixed path device by providing a drive mechanism for horizontal motion, typically linked to the guide links for pivoting the guide links.

FIG. 1 shows the exercise device 100 with the guide link 110 pivoted to a rearward position and the crank system rotated 90 degrees such that the foot support links 118 and 119 are approximately level with each other.

FIGS. 3A-3F are a series of drawings based upon photographs taken by Eadweard Muybridge, showing a runner in motion. The Figures are marked to show the position of the runner's left ankle. FIG. 4 is a graphic depiction of the relative positions of the mark on the user's left ankle corresponding to FIGS. 3A-3F. As shown in FIG. 4, the foot path is not symmetrical front to rear and the rear part of the path is significantly raised in the area of 3E.

As known to those of skill in the art, many elliptical exercise devices do a poor job of mimicking the natural footpath of a runner in motion. One area where the footpaths diverge is in the rear upper area of the path, between 3D and 3E. A natural footpath is more lifted than a typical elliptical device footpath. Some exercise devices attempt to address this in various ways. As an additional aspect of the present invention, some embodiments are configured to provide a lifted footpath when the foot receiving area is at or near its rearmost extent of the path of travel having a horizontal component of motion. Referring again to FIG. 1, the upper axis 142 of the upper pulley 140 is spaced below the first pivot axis 108 supporting the guide link. As such, when the guide link 110 pivots rearwardly, distance between pulley 140 and the end of crank arm 128 is increased, thereby pulling the flexible element 132 by an additional amount and raising the rear of the footpath. This raised footpath is schematically illustrated by dashed lines with a spacing d2 shown at the rear. The upper path is lifted as compared to the lower path. If the upper axis 142 were coaxially aligned with the first pivot axis 108, this additional lift would not occur, as represented by the lower path without lift at d2. As will clear to those of skill in the art, the dashed line is provided only for explaining the concept of the lift and does not represent precise footpaths. The spacing of the upper axis 142 below the first pivot axis 108 would alter other parts of the path, not just the area at d2. However, this aspect of the present invention is directed to providing an altered path by positioning the upper axis 142 below the first pivot axis 108. As will also be clear to those of skill in the art, the amount of lift d2 will depend on the distance d1 and other details of the device configuration. In some specific versions, the spacing of d1 is at least 2 inches and in further versions it is at least 3 inches. Other spacings may be used, depending on the desired footpath and device configuration. Also, some embodiments of the present invention position the upper pulley at other locations, including aligned with the first pivot axis, and the other locations may or may not provide a footpath that is lifted at the rear.

Figure 5:
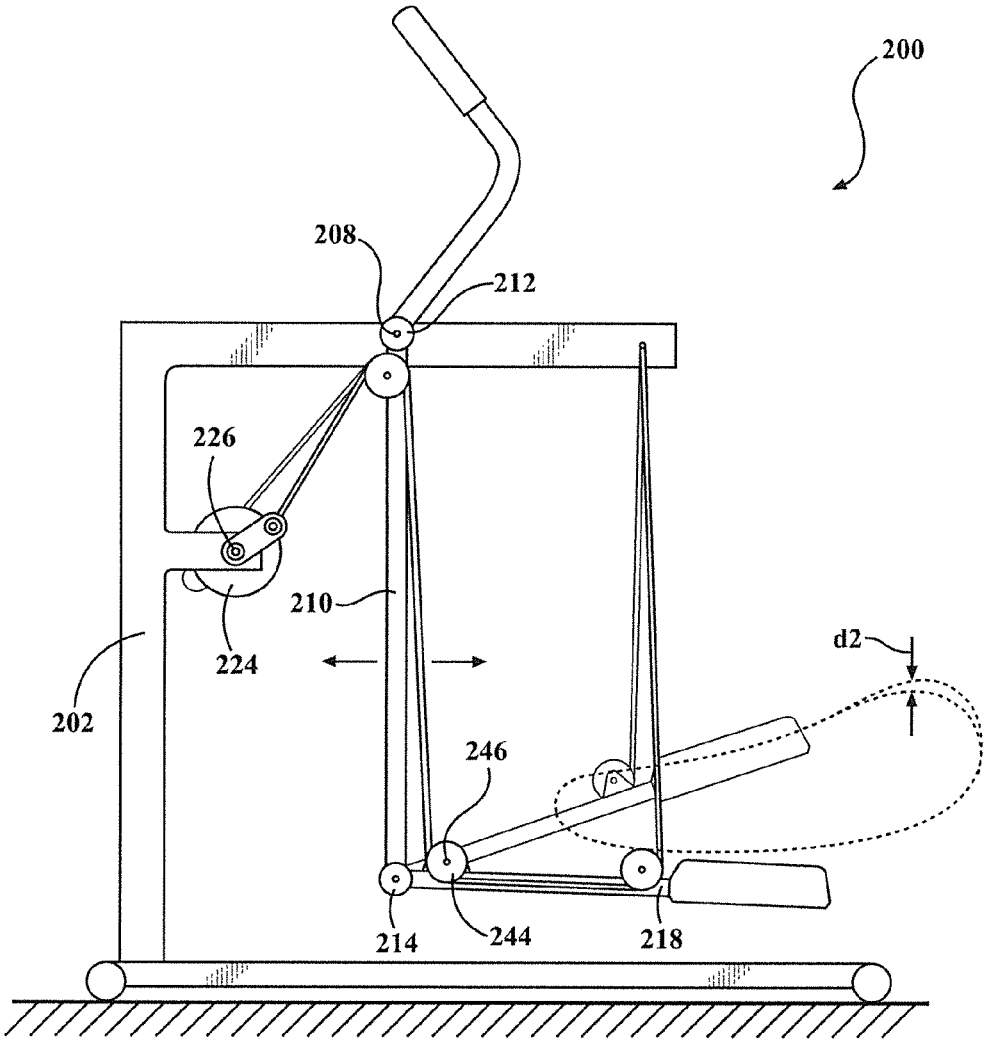
FIG. 5 is a side view of a second embodiment of an exercise device in accordance with the present invention.

Referring now to FIG. 5, a second embodiment of an exercise device in accordance with the present invention is shown generally at 200. Much of the structure is similar to the first embodiment, including a frame 202 having a first pivot axis 208 and a guide link 210 connected to the first pivot axis at its first attachment point 212. A first foot support link 218 is connected to a second attachment point 214 of the guide link 210. The crank system 224 pivotally attached to a second pivot axis on the frame at a crank axis 226. The primary difference between the embodiment 200 and the embodiment 100 is that the front lower pulley 244 is pivotally attached to the foot support link 218 rather than to the guide link 210. The front lower axis 246 is a short distance rearward of the second attachment point 214.

Figure 6:
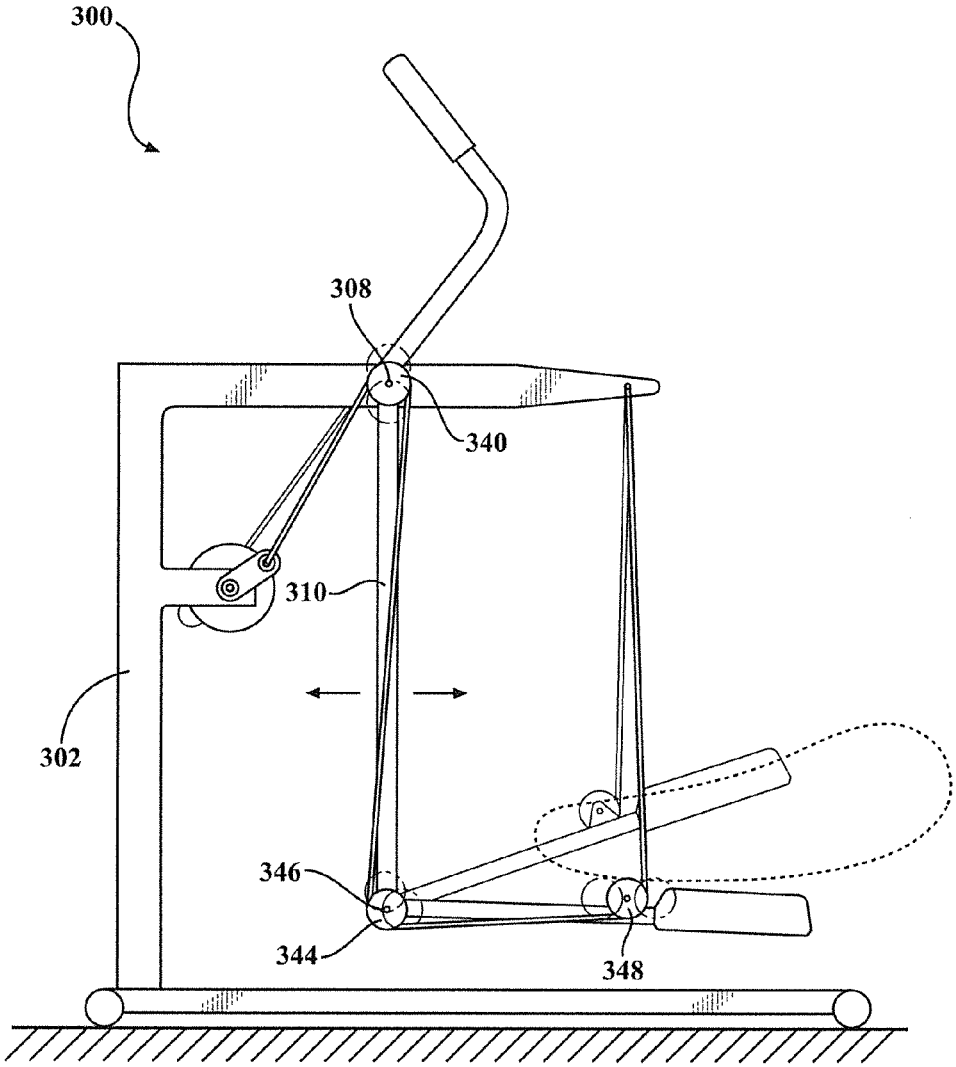
FIG. 6 is a side view of a third embodiment of an exercise device in accordance with the present invention, also showing alternative pulley positions in phantom lines.

Referring now to FIG. 6, a third embodiment of an exercise device in accordance with the present invention is shown generally at 300. Again, this embodiment is similar to the first and second embodiments, including a frame 302 with a guide link 310 pivotally attached at first pivot axis 308. In this embodiment, the upper pulley 340 is aligned with and pivoted about the first pivot axis 308. Also, the front lower pulley 344 is pivotally aligned with the second attachment point, which may be represented by pivot axis 346. The rear lower pulley is at a similar position as in other embodiments. Alternative pulley positions are shown in phantom lines. For example, the upper pulley 340 may be pivoted to the frame forwardly or rearwardly of the first pivot axis 308. It may also be above or below the first pivot axis 308. The front lower pulley 344 may be above or rearward of the second attachment point. The rear lower pulley 348 may be moved forwardly or rearwardly. These pulley positions may be mixed and matched depending on the device, though the positions may impact the footpath and some combinations may be more desirable than others.

Figure 7:
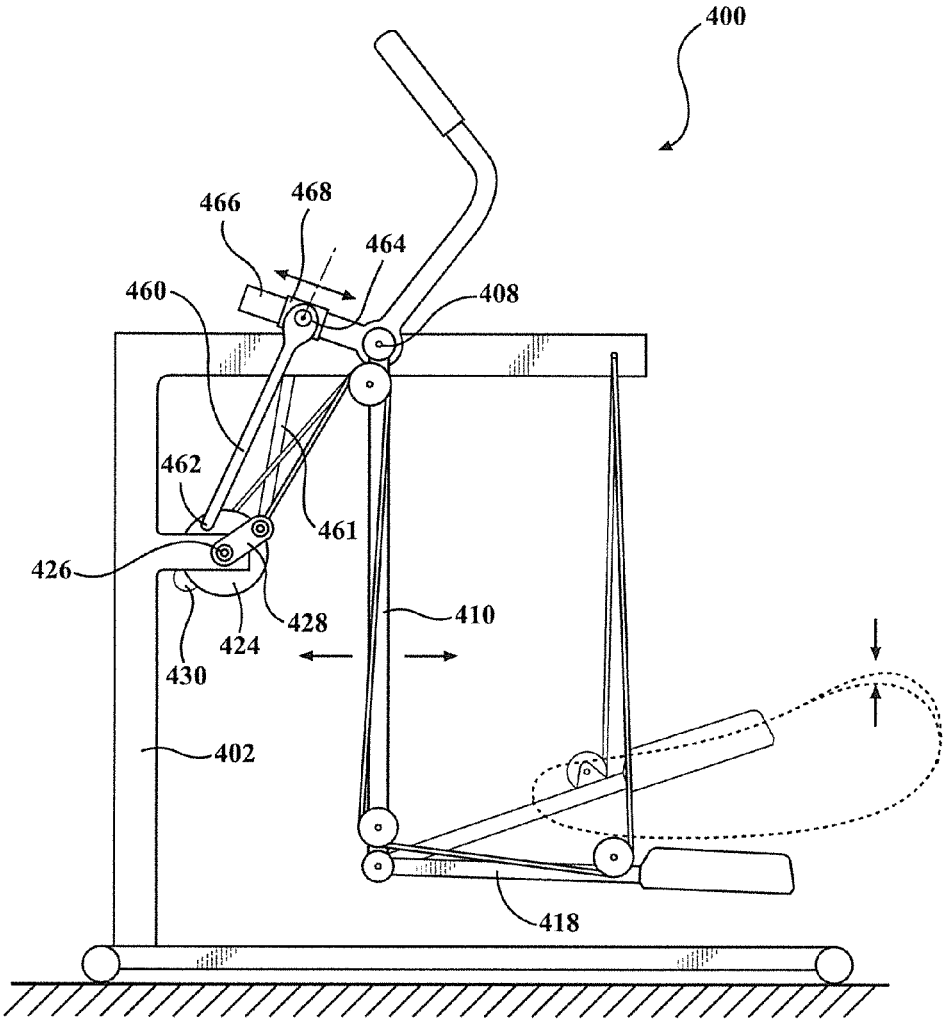
FIG. 7 is a side view of a fourth embodiment of an exercise device in accordance with the present invention.

Referring now to FIG. 7, a fourth embodiment of an exercise device in accordance with the present invention is shown generally at 400. This embodiment is similar to the first embodiments, including a frame 402 with a guide link 410 pivotally attached at first pivot axis 408 and a foot support link 418 attached to the second attachment point 414 of the guide link 410. The crank system 424 and pulley positions are also the same as the first embodiment. The device 400 is a fixed path device with a horizontal drive assembly driving the guide links such that the foot receiving areas move in a path of travel having a horizontal component of motion. In this embodiment, the horizontal drive assembly is part of the crank system 424. Specifically, the cranks system is also a crank for the horizontal drive. A horizontal drive link 460 has a lower 462 end connected to the crank system and an upper end 464 connected to an attachment portion 466 extending forwardly from the remainder of the guide link 410. As such, as the crank system 424 rotates about the crank axis 426, the horizontal drive link 460 causes the guide link 410 to pivot about the first pivot axis 408. A second horizontal drive link 461 controls the other guide link and is attached to the crank at a position 180 degrees from the first horizontal drive link 460. The connection of the horizontal drive links 460 and 461 may be separated from the crank arms by approximately 90 degrees such that horizontal and vertical motions are generally out of phase. In some embodiments, the separation may be more or less than 90 degrees so as to provide a desirable footpath. The connection of the horizontal drive link 460 to the attachment portion is by a slidable collar 468, allowing adjustment of the length of horizontal travel. This adjustment may be manual or by an actuator, not shown.

Figure 8:
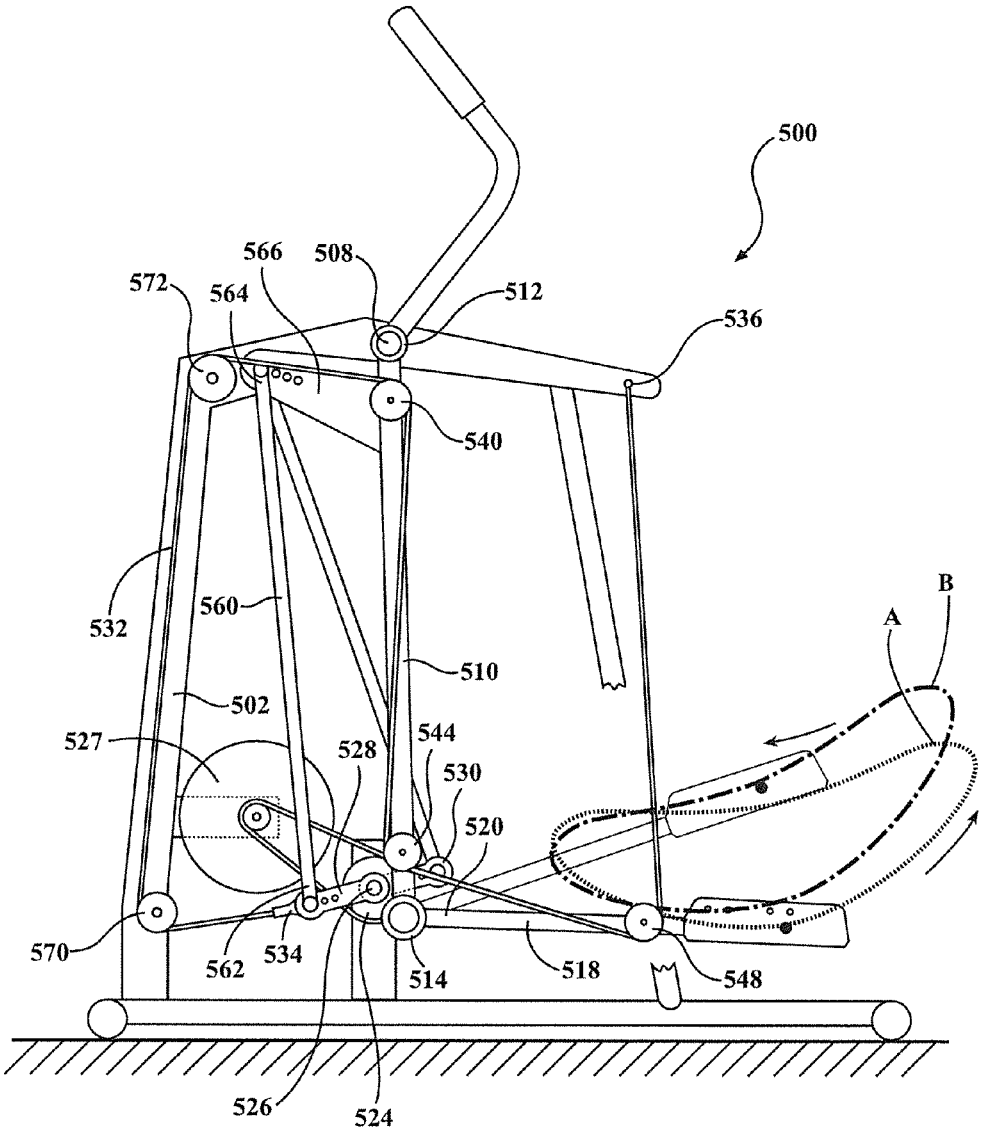
FIG. 8 is a side view of a fifth embodiment of an exercise device in accordance with the present invention.

Referring now to FIG. 8, a fifth embodiment of an exercise device in accordance with the present invention is shown at 500. It shares some elements with earlier embodiments, such as a frame 502 having a first pivot axis 508, a guide link 510 having a first attachment point 512 pivoted to the first pivot axis 508 and a second attachment point 514 at a lower end, and a foot support link 518 with a forward end 520 pivoted to the second attachment point 514. A crank system 524 if pivotally mounted to the frame near a lower end of the frame, with the crank axis 526 slightly forward of the first pivot axis 508. A flywheel and resistance system 527 is coupled to the crank system 524. A flywheel and/or resistance system may be added to any embodiment.

The crank system has crank arms 528 and 530 that are 180 degrees apart. A flexible element 532 has one end 534 coupled to the crank arm 528 and an opposite end 536 coupled to the frame rearward of the first pivot axis 508. The flexible element extends forwardly from the end 534, around a front lower frame pulley 570, which is approximately level with the crank axis 526, then up to an upper frame pulley 572 that is forward of the first pivot axis 508, then rearwardly to the upper pulley 540 on the guide link 510. From this point, the flexible element is routed as in the prior embodiments, extending down to a front lower pulley 544, rearward to a rear lower pulley 548, and up to the frame connection at 536.

A horizontal drive link 560 is connected to the same crank arm 528 and extends generally vertically upwardly to the attachment portion 566 of the guide link 510. As such, the cranks system drives both vertical and horizontal motion. One possible footpath for the device 500 is shown at A and another possible footpath, representing the lift attributable to the spacing of the pulley 540 below the axis 508, is shown at C.

Figure 9:
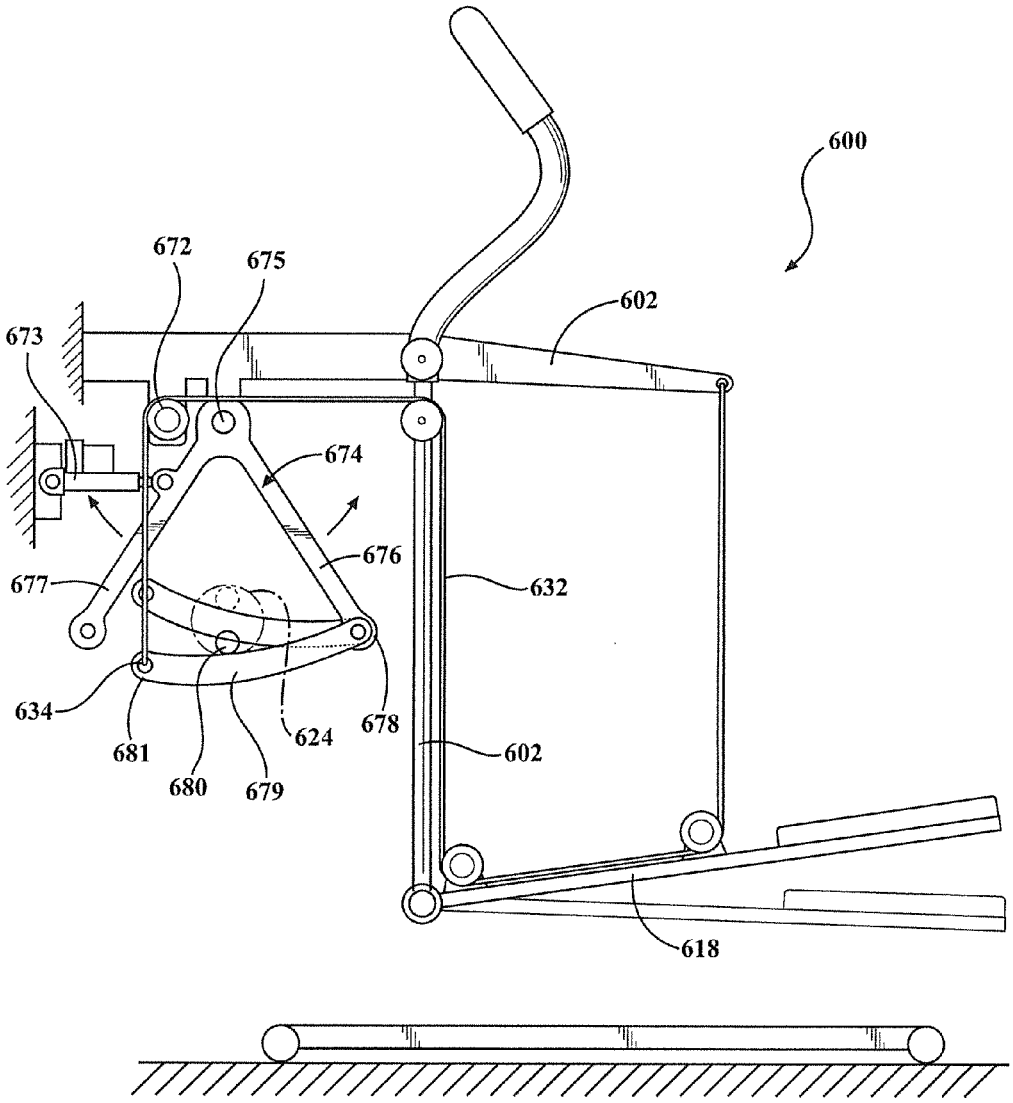
FIG. 9 is a side view of a sixth embodiment of an exercise device in accordance with the present invention.

FIG. 9 illustrates a sixth embodiment of an exercise device 600 that utilizes a cam and follower arrangement, as discussed in the inventors' co-pending U.S. patent application Ser. Nos. 14/643,587 and 14/643,522, filed Mar. 10, 2015. More detailed explanations of various cam and follower arrangements are provided in these co-pending applications. FIG. 9 illustrates only certain elements of the device 600, to make the figure easier to understand. A portion of a frame is shown at 602, supporting a guide link 610, which supports a foot support link 618. A cam system 624 is pivotally supported, typically by a portion of the frame that is not shown in this figure. A follower support rocker 674 is pivoted to the frame at 675 and has two arms. A first arm 676 extends down and rearwardly and a second arm 677 extends down and forwardly. The first arm 676 defines a vertical follower support link and the lower end 678 defines a vertical follower pivot axis. A vertical control follower 679 is pivoted to the lower end 678 and engages an offset portion 680 of the cam system 624 such that as the cam system rotates about a cam axis, a control portion 681 of the follower 679 moves up and down. This system acts as the vertical drive assembly and the flexible element 632 has a first end 634 coupled to the control portion 681 of the follower 679. By pivoting the rocker 674, using actuator 673, the follower pivot axis 678 is moved relative to the cam system 624 so as to adjust the amount of vertical travel. The flexible element 632 extends up to a front frame pivot 672 then rearwardly to a series of pulleys similar to prior embodiments. Though not shown, the cam follower system may also have a horizontal drive portion.

Figure 10:
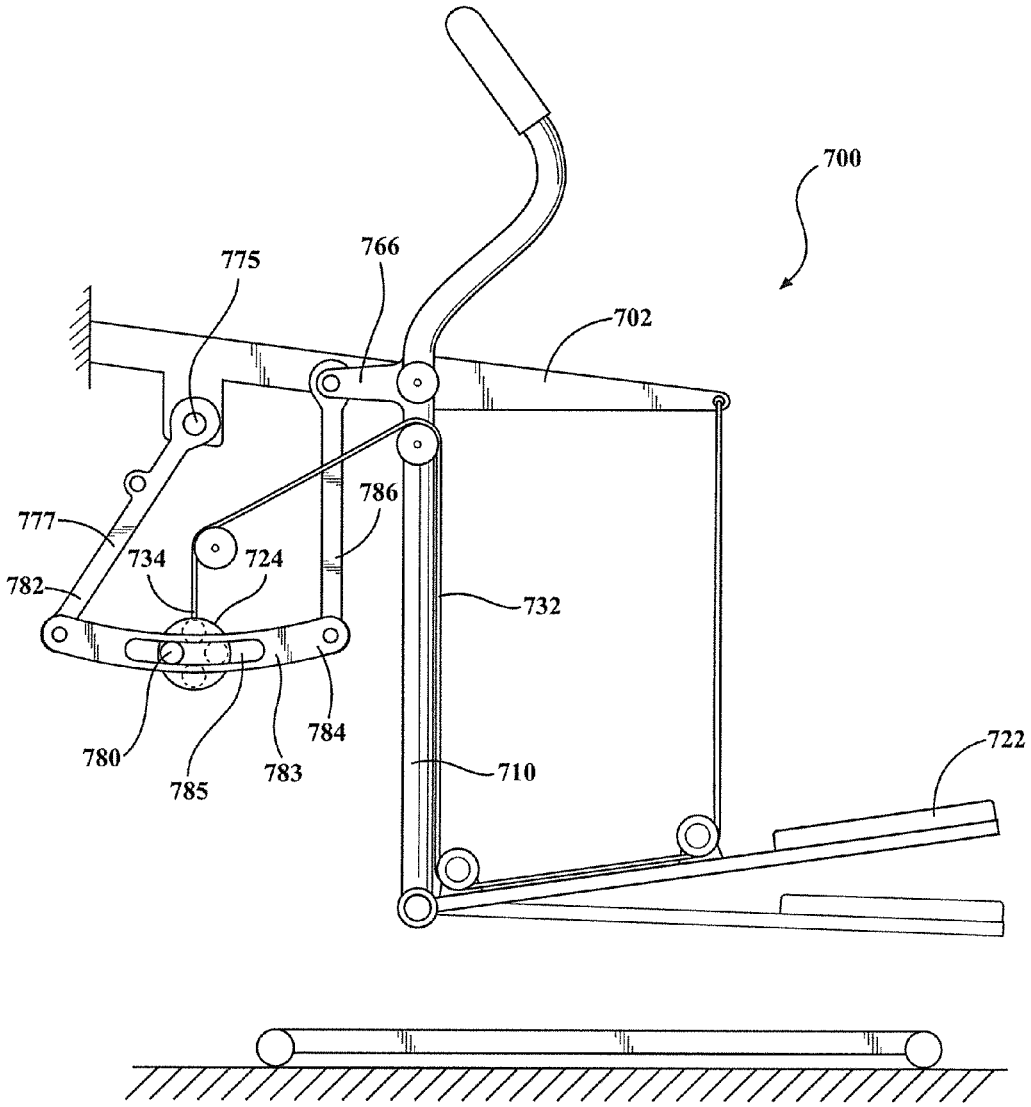
FIG. 10 is a side view of a seventh embodiment of an exercise device in accordance with the present invention.

FIG. 10 shows a seventh embodiment of an exercise device 700, again using a cam and follower arrangement, this time as a horizontal drive assembly. A horizontal follower support link 777 is pivoted to the frame 702 at 775 and has a lower end 782 defining a horizontal follower support pivot. A horizontal control follower 783 is pivoted to the pivot 782 and extend rearwardly to a control portion 784. A cam engagement portion takes the form of a cam engagement slot 785, with an inner surface defining a cam engagement surface. The cam system 724 has an offset horizontal control portion 780 engaging the slot such that rotation of the cam system causes movement of the control portion 784 of the follower 783. The link 777 may be moved, such as by an actuator, not shown, to adjust horizontal travel. A horizontal control link 786 links the control portion 784 of the follower to the attachment portion 766 of the guide link 710 such that rotation of the cam system 724 causes horizontal travel of the foot receiving area 722. The cam system 724 also acts as a vertical drive assembly, with the first end 734 of the flexible element 732 connected to the cam system such that the cam system acts like a crank.

Figure 11:
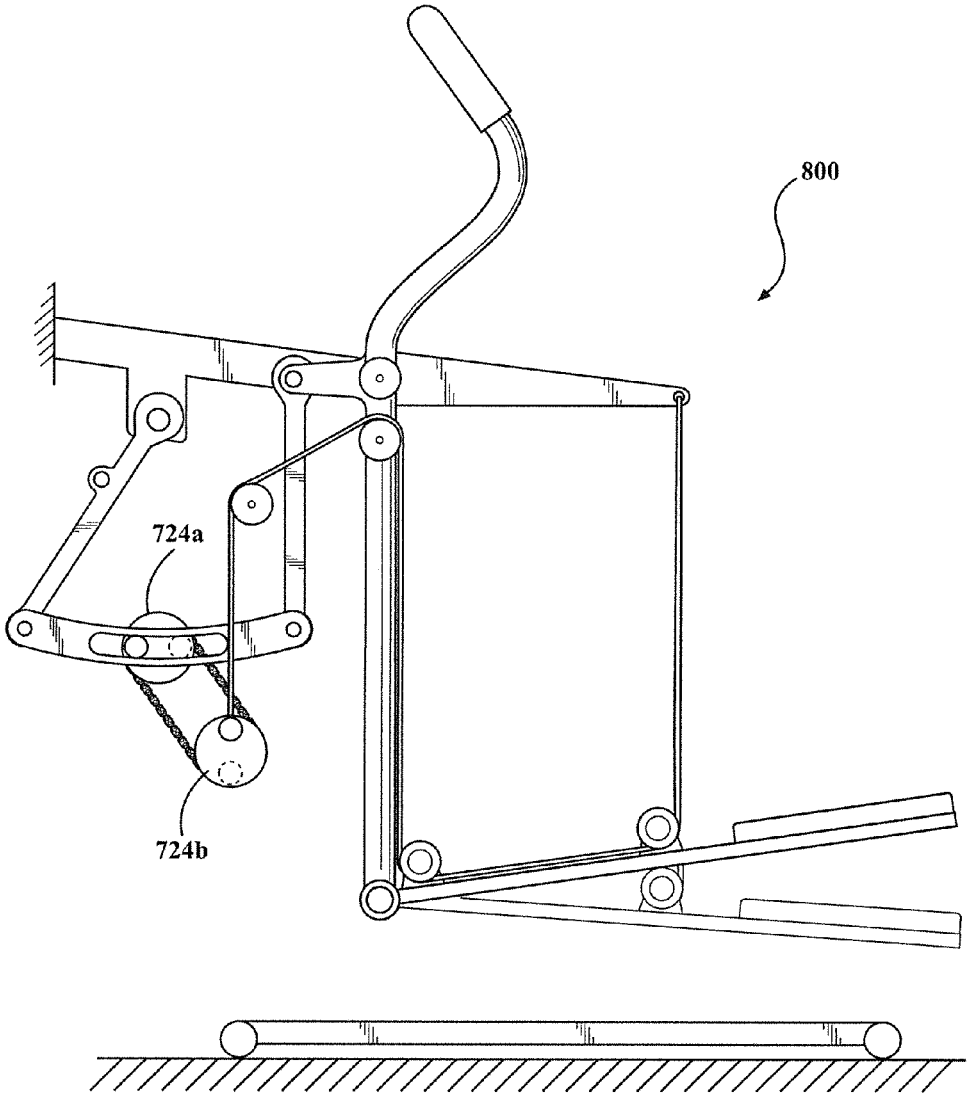
FIG. 11 is a side view of an exercise device in accordance with an eighth embodiment of the present invention.

FIG. 11 illustrates an eighth embodiment of an exercise device 800, which is very similar to the seventh embodiment. It differs in that the cam system is separated into a horizontal control cam portion 724*a* and a vertical crank portion 724*b*, interconnected by a belt.

Figure 12:
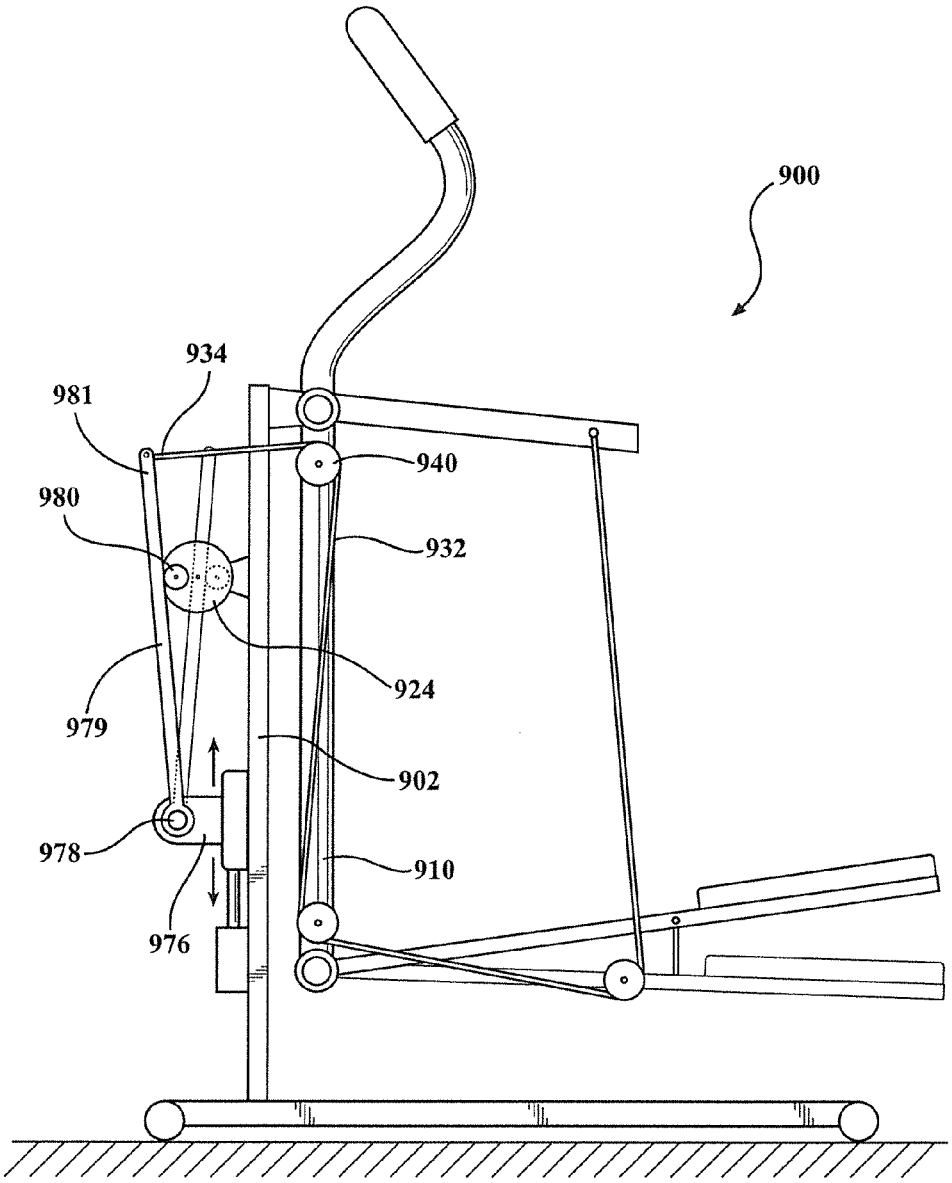
FIG. 12 is a side view of an exercise device in accordance with a ninth embodiment of the present invention.

FIG. 12 illustrates a ninth embodiment of an exercise device 900, which may be a free stride type device. In this embodiment, a linearly movable vertical follower support 976 is disposed on the frame 902 and a vertical control follower 979 is pivoted to the support 976. An actuator may move the support. The vertical control follower 979 has a lower end 978 pivoted to the support 976 and extends generally vertically upward to an upper end 981 defining a control portion of the follower. A mid portion of the follower defines a cam engagement portion and engages an offset vertical control cam portion 980 of the cam system 924. The first end 934 of the flexible element 932 is connected to the control portion 981 of the follower 979. The flexible element then extends rearwardly to the upper pulley 940 on the guide link 910. The remainder of the flexible element routing is similar to prior embodiments.

Figure 13:
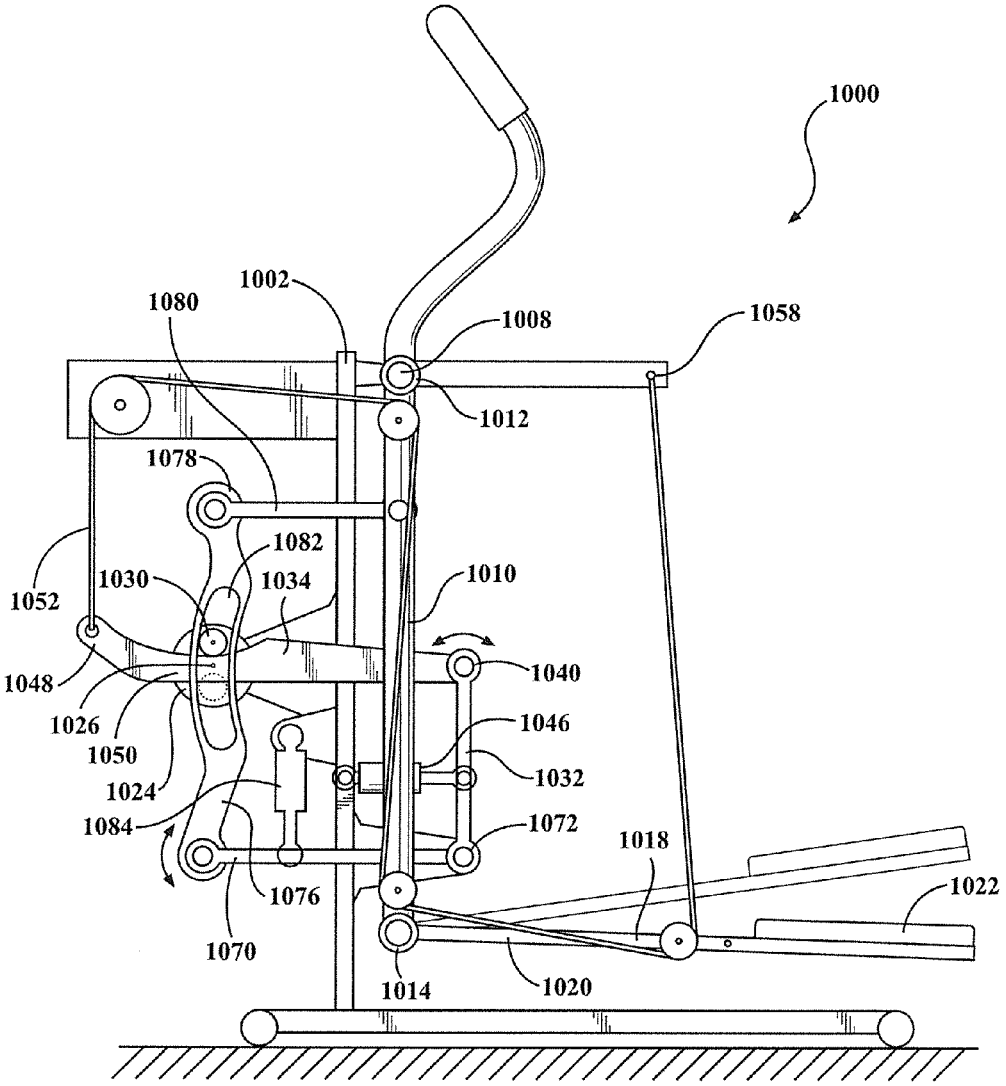
FIG. 13 is a side view of a tenth embodiment of an exercise device in accordance with the present invention.

Referring now to FIG. 13, a tenth embodiment of an exercise device in accordance with the present invention is shown generally at 1000. As with earlier embodiments, the device 1000 includes a frame 1002 with a first pivot axis 1008; a guide link 1010 having a first attachment point 1012 attached to the first pivot axis 1008 and a second attachment point 1014; and a foot support link 1018 having a forward end 1020 pivotally attached to the second attachment point 1014 of the guide link 1010 and a foot receiving area 1022 at a rearward end of the foot support link 1018. A vertical follower support link 1032 and a horizontal follower support link 1070 are both pivotally attached to a third pivot axis 1072 of the frame 1002, with the vertical follower support link extending upwardly and the horizontal follower support link 1070 extending forwardly. A vertical control follower 1034 is pivotally attached to a follower end 1040 of the follower support link 1032 and extends forwardly to a control portion 1048. A mid portion 1050 of the vertical control follower 1034 serves as a cam engagement portion and engages the offset portion 1030 of the cam system 1024. A flexible element 1052 has one end coupled to the control portion 1048 of the follower 1034 and a second end 1058 coupled to the frame 1002, with the routing of the flexible element being similar to prior embodiments. As with other embodiments, this embodiment has a parallelogram-type arrangement.

A horizontal control follower 1076 is pivotally attached to a follower end of the horizontal follower support link 1070 and extends upwardly to a control portion 1078. A mid portion of the follower 1076 has a slot 1082 defined therein that serves as an engagement portion for engaging the offset portion 1030 of the cam system 1024. A horizontal control link 1080 couples the control portion 1078 of the horizontal control follower 1076 to the guide link 1010. As will be clear from a review of the figures, as the cam system 1024 rotates about the cam axis 1026, the offset portion 1030 acts as both a horizontal control portion and a vertical control portion of the cam system and causes both the followers 1034 and 1076 to oscillate such that the foot receiving area 1022 is caused to travel along a generally elliptical path. In this embodiment, the offset vertical drive portion and offset horizontal drive portion of the cam system for the first guide link and foot support link are coaxial with each other and the offset drive portions for the second guide link and foot support link are also coaxial with each other. The actuators 1046 and 1084 may be used to adjust the position of the vertical follower support link 1032 and the horizontal follower support link 1070, respectively, so as to adjust the range of vertical and horizontal travel. Alternatively, the vertical follower support link 1032 and horizontal follower support link 1070 may be interconnected as one element or interlinked in a variety of ways so as to allow coordinated adjustment. As shown, in this embodiment, the horizontal control follower 1076 and the vertical control follower 1034 are generally perpendicular to each other.

Figure 14A:
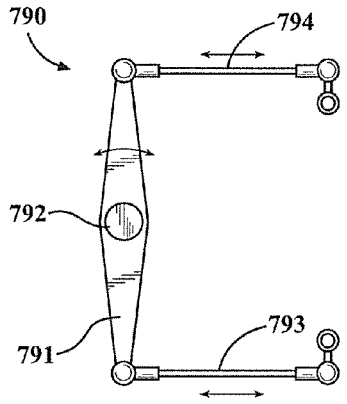
FIG. 14A is a view taken along lines 14A-14A of FIG. 14 showing the coordination linkage.
Figure 14:
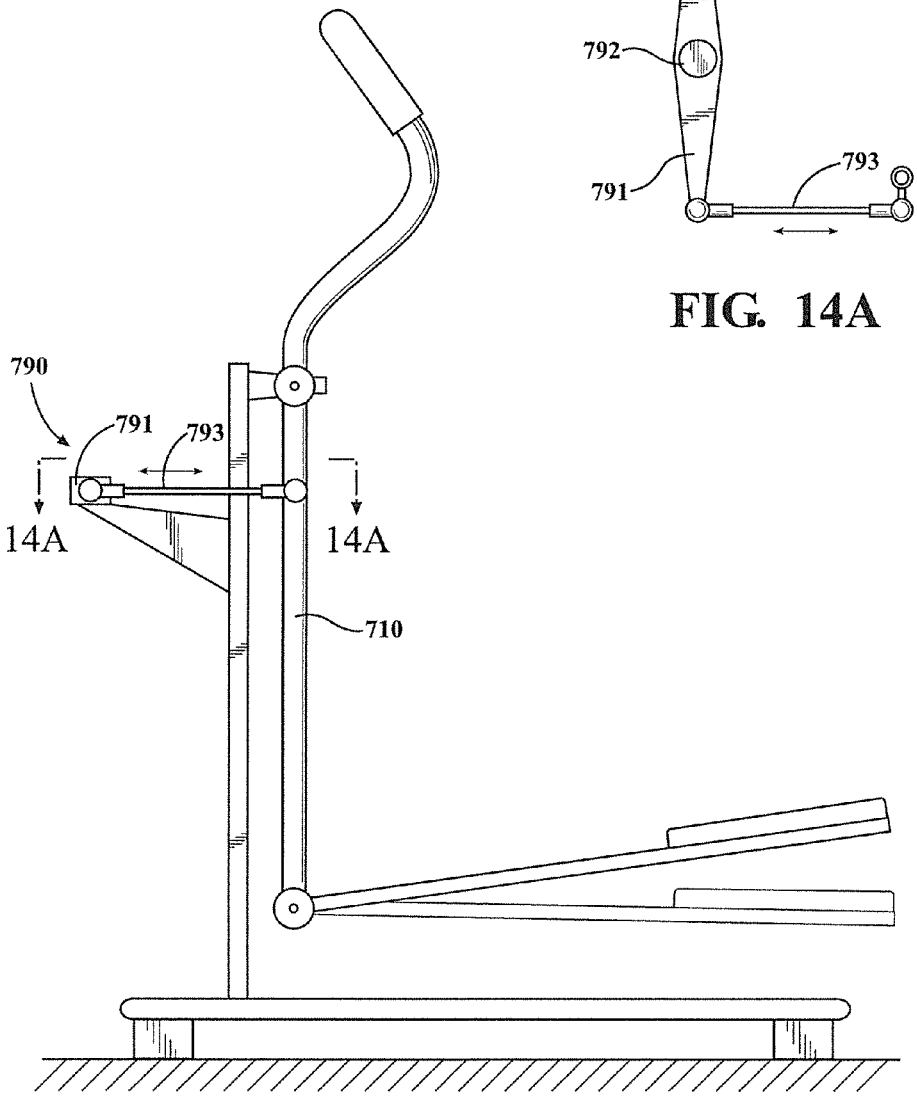
FIG. 14 is a side view of a portion of an exercise device showing a horizontal coordination mechanism that may be used with some embodiments of the present invention.

As will be clear to those of skill in the art, it is desirable in a free stride type exercise device to coordinate the movement of the foot receiving areas such that as one area moves rearwardly, the other area moves forwardly by an equal amount. FIGS. 14 and 14A illustrate one version of a horizontal coordination linkage 790 for providing such coordinated movement. The linkage 790 has a cross member 791 with a mid portion pivotally attached to the frame at 792. One end of the cross member 792 is interconnected with the left guide link 710 by a left link 793 and the other end is interconnected with the right guide link by a right link 794. It may also be desirable to provide resistance to this horizontal travel. Resistance may be provided in a variety of ways, such as a resistance element at the pivotal connection 792. An additional resistance element may be interconnected with the coordination linkage or with the individual guide links in other ways. A coordination linkage such as 790, or of other types, may be used with any embodiment of the present invention in which this type of coordination is desirable, typically a free stride type device. Resistance for horizontal motion may also be added to any embodiment.

As will be clear to those of skill in the art, the embodiments of the present invention illustrated and discussed herein may be altered in various ways without departing from the scope or teaching of the present invention. As one non-limiting example, some embodiments may dispense with the front lower pulley with the flexible element extending from the upper pulley to the rear lower pulley. Also, elements and aspects of one embodiment may be combined with elements and aspects of another embodiment. It is the following claims, including all equivalents, which define the scope of the present invention.

The invention claimed is:

1. An exercise device comprising:

a frame configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion;

a first and a second upper pulley each pivotally connected to the frame or a respective one of the guide links, each upper pulley rotating about an upper axis;

a first and a second front lower pulley each pivotally connected to a respective one of the guide links or foot support links below the upper pulleys, each front lower pulley rotating about a front lower axis;

a first and a second rear lower pulley each pivotally connected to a respective one of the foot support links rearward of the respective front lower pulley, each rear lower pulley rotating about a rear lower axis;

a vertical drive assembly supported on the frame;

a first and a second flexible element each having a first end in communication with the vertical drive assembly, a second end connected to the frame rearward of the first pivot axis and a midportion extending between the first and second ends, the midportion of each flexible element extending about a respective upper pulley, front lower pulley and rear lower pulley;

wherein the vertical drive assembly is operable via the flexible elements to move the foot receiving areas of the foot support links in a path of travel having a vertical component of motion.

2. An exercise device in accordance with claim 1, wherein the upper pulleys are pivotally connected to the respective guide link and the upper axis of the upper pulleys are each offset downwardly from the first attachment point, whereby when each foot receiving area is at its rearmost extent of the path of travel having a horizontal component of motion, the foot receiving area is lifted upwardly by the respective flexible element as compared to if the upper axis was aligned with the first attachment point.

3. An exercise device in accordance with claim 2, wherein the upper axis of the upper pulleys are each offset downwardly from the first attachment point by a distance of at least 2 inches.

4. An exercise device in accordance with claim 2, wherein the upper axis of the upper pulleys are each offset downwardly from the first attachment point by a distance of at least 3 inches.

5. An exercise device in accordance with claim 1, wherein:

each of the guide links has a guide length defined between the first and second attachment point; and each of the flexible elements has a foot support portion extending between the respective rear lower pulley and a frame attachment point on the frame, the foot support portion being generally parallel to the respective guide link throughout the motion of the device.

6. An exercise device in accordance with claim 5, wherein:

the foot support portion has a length when the respective foot support link is at a midpoint of vertical travel that is similar to the guide length;

wherein the respective first attachment point, second attachment point, rear lower pulley and frame attachment point generally define a parallelogram when the respective foot support link is at the midpoint of vertical travel.

7. An exercise device in accordance with claim 1, wherein the pivotal motion of the guide links about the first attachment points is decoupled from the motion of the foot receiving areas along the path of travel having a vertical component of motion so that the user can achieve a foot path that is generally vertical or a blend of vertical and horizontal motion.

8. An exercise device in accordance with claim 1, further comprising:

a horizontal drive assembly supported on the frame; and a first and a second mechanical horizontal control coupling each coupling a respective one of the guide links to the horizontal drive assembly such that the horizontal drive assembly is operable to pivot the guide links about the first pivot axis, thereby causing the foot receiving areas to move in the path of travel having a horizontal component of motion;

wherein movement of each foot receiving area in the path of travel having a vertical component of motion is generally out of phase with the movement in the path of travel having a horizontal component of motion such that when the horizontal component of motion of each foot receiving area is at its forwardmost or rearwardmost limit, the vertical component of motion of the same foot receiving area is approximately midway between its uppermost and lowermost limit, whereby the foot receiving area of each foot support link moves in a generally elliptical path.

9. An exercise device in accordance with claim 8, further comprising a crank system supported on the frame for rotation about a crank axis, the crank system defining the vertical drive assembly and the horizontal drive assembly.

10. An exercise device in accordance with claim 9, wherein the mechanical horizontal control couplings each comprise a horizontal control link having one end connected to the crank system and an opposite end connected to a respective one of the guide links.

11. An exercise device in accordance with claim 10, wherein the horizontal control link is connected to an attachment portion of the respective guide link, the connection to the attachment portion being adjustable such that a range of the path of travel having a horizontal component of motion is adjustable.

12. An exercise device in accordance with claim 1, wherein the vertical drive assembly comprises a crank supported on the frame for rotation about a crank axis, the crank having a first and a second crank arm each coupled to a respective one of the flexible elements.

13. An exercise device in accordance with claim 1, further comprising:

a cam system having a vertical control cam portion and a horizontal control cam portion, the cam portions supported for rotation about cam axes, the vertical control cam portion having a first and a second offset vertical drive portion, the horizontal control cam portion having a first and second offset horizontal drive portion;

a vertical follower support disposed on the frame, the vertical follower support having a vertical follower pivot axis defined thereon;

a first and a second vertical control follower each pivotally connected to the vertical follower support at the vertical follower pivot axis, each vertical control follower further having a control portion and a cam engagement portion, the cam engagement portion having a cam engagement surface engaging a respective one of the offset vertical drive portions of the vertical cam portion such that as the vertical cam portion rotates about the respective cam axis, the offset vertical drive portions cause the vertical control followers to pivot back and forth about the vertical follower pivot axis thereby causing the control portions to oscillate back and forth;

wherein the control cam portion, vertical follower support, and vertical control followers define the vertical drive assembly and the first end of each flexible element is connected to the control portion of the respective one of the vertical control followers;

a horizontal follower support disposed on the frame, the horizontal follower support having a horizontal follower pivot axis defined thereon;

a first and a second horizontal control follower each pivotally connected to the horizontal follower support at the horizontal follower pivot axis, each horizontal control follower further having a control portion and a cam engagement portion, the cam engagement portion having a cam engagement surface engaging a respective one of the offset horizontal drive portions of the horizontal cam portion such that as the horizontal cam portion rotates about the respective cam axis, the offset horizontal drive portions cause the horizontal control followers to pivot back and forth about the horizontal follower pivot axis thereby causing the control portions to oscillate back and forth; and a first and a second mechanical horizontal control coupling each coupling a respective one of the guide links to the control portion of a respective one of the horizontal control followers such that as the horizontal cam portion rotates about the respective cam axis, the mechanical horizontal control couplings pivot the guide links about the first pivot axis, thereby moving the foot support areas of the foot support links in a path of travel having a horizontal component of motion;

movement of each foot receiving area in the path of travel having a vertical component of motion being generally out of phase with the movement in the path of travel having a horizontal component of motion such that when the horizontal component of motion of each foot receiving area is at its forwardmost or rearwardmost limit, the vertical component of motion of the same foot receiving area is approximately midway between its uppermost and lowermost limit;

whereby the foot receiving area of each foot support link moves in a generally elliptical path when the cam portions rotate about the cam axes.

14. An exercise device in accordance with claim 13, wherein:

the first offset vertical drive portion and the first offset horizontal drive portion are generally coaxial; and the second offset vertical drive portion and the second offset horizontal drive portion are generally coaxial.

15. An exercise device in accordance with claim 13, wherein:

the vertical control followers are disposed generally perpendicular to the horizontal control followers.

16. An exercise device in accordance with claim 13, wherein:

at least one of the follower supports is a movable support operable to move the respective follower pivot axis relative to the respective cam axis so as to alter a range of travel of the control portion of the respective control followers; and further comprising a control actuator operable to move the at least one of the follower supports.

17. An exercise device in accordance with claim 13, wherein the control followers are each elongated elements selected from the group consisting of:

each having one end pivotally connected to the respective follower support, an opposite end defining the control portion, and a midportion defining the cam engagement portion;

each having one end pivotally connected to the respective follower support, an opposite end defining the cam engagement portion, and a midportion defining the control portion; and each having one end defining the cam engagement portion, an opposite end defining the control portion, and a midportion pivotally connected to the respective follower support.

18. An exercise device in accordance with claim 13, wherein the cam engagement portion of each elongated horizontal control follower is a slot defined in the elongated element.

19. An exercise device in accordance with claim 1, further comprising:

a cam system having a vertical control cam portion and a horizontal control cam portion, the cam portions supported for rotation about cam axes, the vertical control cam portion having a first and a second offset vertical drive portion, the horizontal control cam portion having a first and second offset horizontal drive portion;

a vertical follower support disposed on the frame, the vertical follower support having a vertical follower pivot axis defined thereon; and a first and a second vertical control follower each having a lower end pivotally connected to the vertical follower support at the vertical follower pivot axis, each vertical control follower further having an upper control portion and a cam engagement portion, the cam engagement portion having a cam engagement surface engaging a respective one of the offset vertical drive portions of the vertical cam portion such that as the vertical cam portion rotates about the respective cam axis, the offset vertical drive portions cause the vertical control followers to pivot back and forth about the vertical follower pivot axis thereby causing the control portions to oscillate back and forth;

wherein the control cam portion, vertical follower support, and vertical control followers define the vertical drive assembly and the first end of each flexible element is connected to the control portion of the respective one of the vertical control followers.

20. An exercise device in accordance with claim 19, wherein each flexible element extends generally rearwardly from the respective control portion to the respective upper pulley.

21. An exercise device in accordance with claim 1, wherein each front lower pulley is connected to the respective guide link and the front lower axis of each front lower pulley is spaced above the respective second attachment point of the respective guide link.

22. An exercise device in accordance with claim 1, wherein each front lower pulley is connected to the respective foot support link and the front lower axis of each front lower pulley is spaced behind the respective second attachment point of the respective guide link.

23. An exercise device in accordance with claim 1, wherein each foot support link has a forward end that is pivotally connected to the second attachment point of the respective guide link and a rearward end defining the foot receiving area, each rear lower pulley being connected to the respective foot support link between the forward and rearward ends of the foot support link.

24. An exercise device in accordance with claim 1, wherein each of the guide links further includes a hand grip portion extending upwardly from the first attachment point.

25. An exercise device in accordance with claim 1, further comprising an adjustable resistance element coupled to the vertical drive assembly.

26. An exercise device in accordance with claim 1, further comprising:

a horizontal coordination linkage linking the first guide link to the second guide link such that pivotal movement of one of the guide links in a first direction causes pivotal movement of the other of the guide links in an opposite direction; and an adjustable horizontal resistance element coupled to the guide links for providing resistance to the path of travel having a horizontal component of motion.

27. An exercise device comprising:

a frame configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof, each of the guide links having a guide length defined between the first and second attachment point;

a first and a second foot support link each having a foot receiving area to support a user's foot thereupon, each foot support link having a forward end pivotally connected to the second attachment point of a respective one of the guide links so that when the guide links pivot relative to the frame, the guide links each cause the foot receiving area of the respective foot support link to move in a path of travel having a horizontal component of motion;

a first and a second upper pulley each pivotally connected to the frame or a respective one of the guide links, each upper pulley rotating about an upper axis;

a first and a second lower pulley each pivotally connected to a respective one of the foot support links rearward of the forward end, each lower pulley rotating about a lower axis;

a vertical drive assembly supported on the frame; and a first and a second flexible element each having a first end in communication with the vertical drive assembly, a second end connected to the frame rearward of the first pivot axis and a midportion extending between the first and second ends, the midportion of each flexible element extending about a respective upper pulley and rear lower pulley, each of the flexible elements having a foot support portion extending between the respective lower pulley and the frame, the foot support portion being generally parallel to the respective guide link throughout the elliptical motion of the device, the foot support portion further having a length when the respective foot support link is at a midpoint of vertical travel that is similar to the guide length;

wherein the vertical drive assembly is operable via the flexible elements to move the foot receiving areas of the foot support links in a path of travel having a vertical component of motion.

* * * * *